United States Patent [19]

Buckner et al.

[11] 4,448,185

[45] May 15, 1984

[54] AIR COOLED DOOR HANDLE FOR HEATERS

[75] Inventors: Carrol E. Buckner; Clarence G. Cook, both of Weaverville; Thomas J. Kane, Asheville, all of N.C.

[73] Assignee: Buck Stove Corporation, Asheville, N.C.

[21] Appl. No.: 943

[22] Filed: Jan. 4, 1979

[51] Int. Cl.[3] ..... F23M 7/00

[52] U.S. Cl. ..... 126/193; 126/77; 110/175 R

[58] Field of Search ..... 403/197, 194; 292/202, 292/212; 16/116; 73/191, 194; 126/190, 191, 192, 193, 194; 74/543, 544; 110/175 R, 180, 182

[56] References Cited

U.S. PATENT DOCUMENTS

| | | | |
|---|---|---|---|
| 312,940 | 2/1885 | Whitlock | 16/118 |
| 373,181 | 11/1887 | Gaitley | 16/118 |
| 720,626 | 2/1903 | Schulte | 126/77 |
| 1,916,848 | 7/1933 | North | 292/202 |
| 2,505,312 | 4/1950 | Wagner | 403/194 |
| 2,578,230 | 12/1951 | Davis | 16/116 |
| 3,409,003 | 11/1968 | Rehberg et al. | 126/190 |

*Primary Examiner*—Samuel Scott
*Assistant Examiner*—G. Anderson
*Attorney, Agent, or Firm*—Leitner, Martin

[57] ABSTRACT

The door handle of a heating unit is cooled by providing a duct traversing the interior of the handle from exterior of the firebox of the heating unit to the interior of the firebox. The induced flow cools the handle and provides cool air in the firebox to trap and maintain the hot gasses closer to the fire for a more complete combustion. An open, ellipsoid, spiral coil surrounds the grip of the handle.

20 Claims, 4 Drawing Figures

AIR COOLED DOOR HANDLE FOR HEATERS

BACKGROUND OF THE INVENTION

The present invention relates generally to heating unit door handles, and more specifically to an air cooled heating unit door handle.

The handles of doors for heating units, for example, stoves or fireplaces, are generally made of metal and conduct the heat from the metal door to which they are attached. One solution to this problem has been to provide a cover on the handle to isolate transmission of heat to the user. Another solution has been to form the handles of other materials having a lower coefficient of heat transfer. For various reasons, including cost, aesthetics, etc., these solutions have not been implemented. Thus there exists a need for a handle for the door of a heating unit which is capable of being maintained at a temperature relatively cool to the touch.

SUMMARY OF THE INVENTION

The present invention is a handle for a heating unit having a central bore communicating the exterior of a firebox to the interior of the firebox such that cool air is drawn through the handle to substantially cool the handle material. The handle may be generally L-shaped, made of metal, and includes a centralized bore. The handle may be fixedly mounted to the door or may be rotatably mounted, having a latch on the firebox side thereof. The rotatable handle is mounted to the door through a bushing, having internal threaded portions corresponding to the threaded portions on the handle. A wire is coiled around the grip portion of the handle in a substantially open ellipsoid shape. The door includes adjustable draft openings adjacent to the bottom thereof which are at or below the height of the firebed in the firebox. The handles are mounted to the door substantially adjacent to the top thereof to introduce cold air above the firebed to trap and maintain the hot gases closer to the fire for a more complete combustion. The coiled wires and the grip of the adjustable draft openings on the door are coated with a silicon thermal insulation.

OBJECT OF THE INVENTION

An object of the invention is to provide an inexpensive cool handle for the door of heating units.

Another object is to provide an aesthetically pleasing, cool handle for the door of a heating unit.

A further object is to provide a method of cooling the handle of the door of a heating unit using an induced cool air flow into a firebox.

An even further object of the invention is to provide a means for insulating the grips of door handles and adjustable draft openings on the door of a heating unit.

A still further object of the invention is to provide a method of introducing cold air above the fire for more complete combustion of hot gases without substantial modification of the heating unit.

A still even further object of the present invention is to reduce the temperature of the flue gases by producing a more complete combustion of these gases.

Other objects, advantages and features of the invention will become apparent from the following detailed description of the invention when considered in conjunction with the accompanying drawings.

A BRIEF DESCRIPTION OF THE DRAWINGS

DESCRIPTION OF THE PREFERRED EMBODIMENTS

Figure 1:
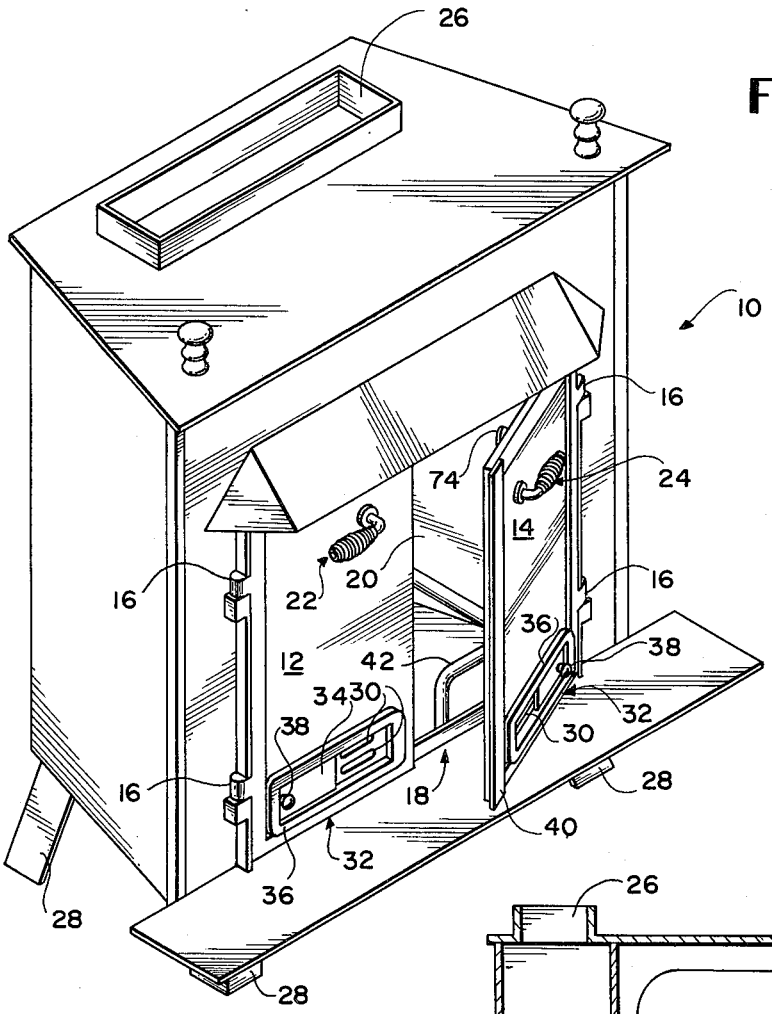
FIG. 1 is a perspective view of a heating unit incorporating the principles of the present invention.

FIG. 1 illustrates a combined stove and fireplace 10 which is representative of a type of heating unit. A pair of doors 12 and 14 are pivotally mounted at 16 to the front of the heating unit 10 to cover an access opening 18 to the interior of the firebox 20. Door 12 has a handle 22 fixedly mounted thereto and door 14 has a handle 24 rotatably mounted thereto. The exhaust gases from the firebox 20 exit through flue port 26 in the top of the heating unit 10. Legs 28 support the heating unit and separate it from the floor.

Each door, 12, 14, includes draft openings 30 adjacent to the bottom of the door which are adjustably varied by draft control 32. The draft control 32 includes a slide 34 moving along the face of the door in race 36 and includes an adjustable hand grip or knob 38. Knob 38 may be a threaded element which allows adjustment and locking of the slide 34 in the desired position to vary the size of draft openings 30.

A vertical strip 40 extends beyond the lateral edge of door 14 and across door 12 when both of the doors are in a closed position to hold door 12 closed. As will be explained, handle 24 includes a latch mechanism such that both doors may be held closed using a single latched handle. Andirons 42 are provided or any other type of grate to define a firebed which allows air to circulated under the material to be burned.

Figure 2:
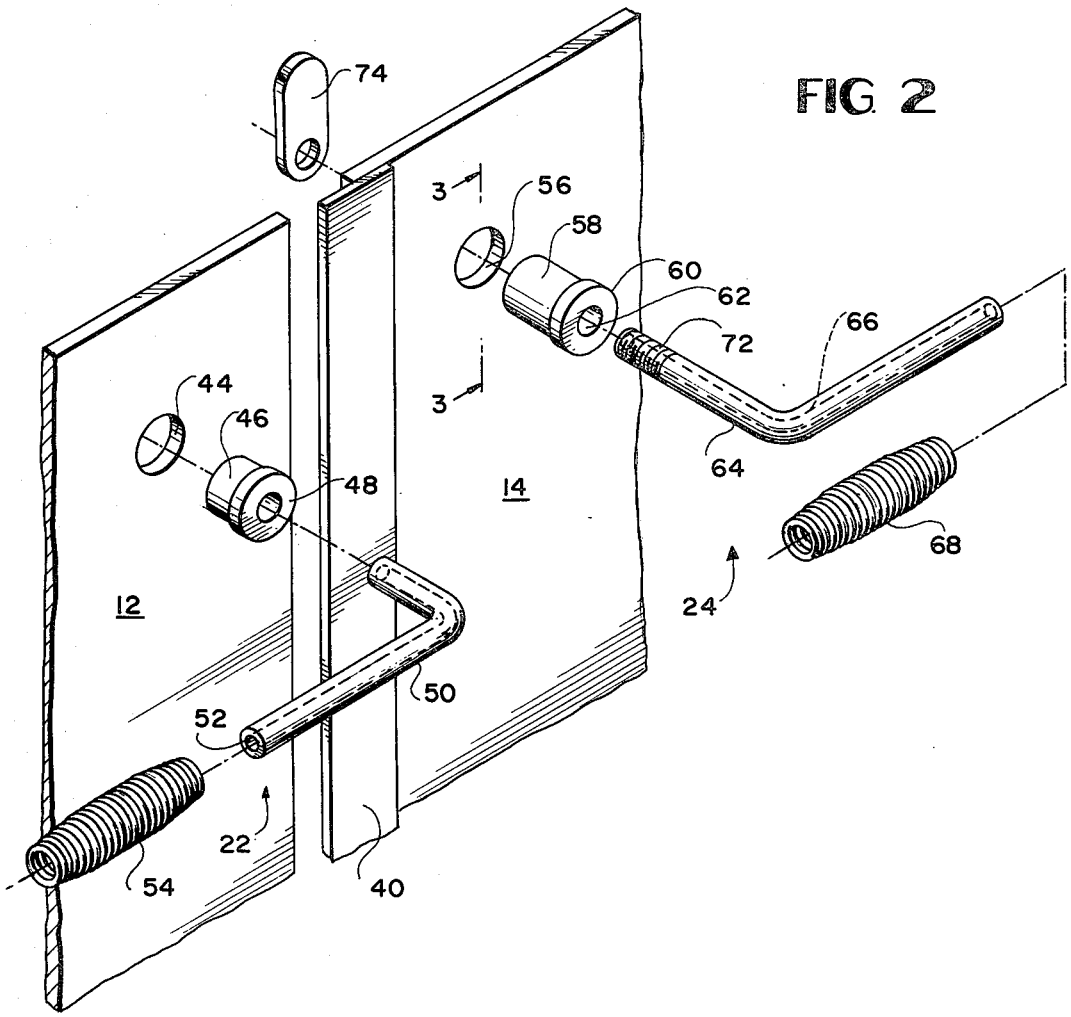
FIG. 2 is an exploded perspective view of a heating unit door and a handle designed according to the principles of the present invention.
Figure 3:
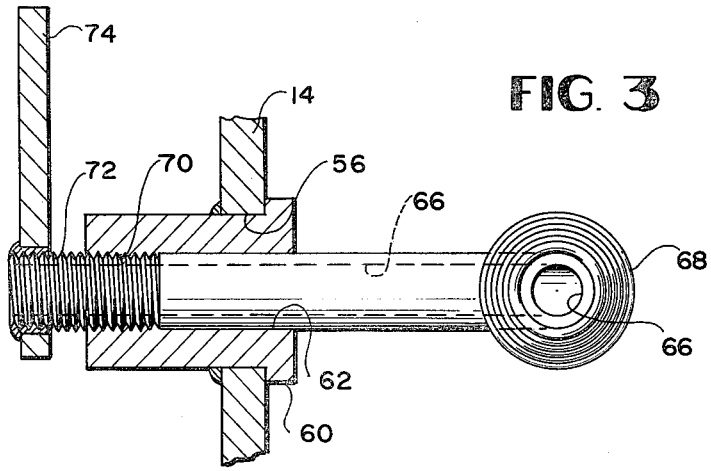
FIG. 3 is a cross-sectional view of the handle assembled to a door.

Details of the construction of the door handles and their assembly to the doors is illustrated in FIGS. 2 and 3. Door 12 has aperture 44 therein to receive a bushing 46 having a collar 48 to limit the rearward extension of the bushing 46 through the door. The bushing 46 is secured to the door by a weld. A generally cylindrical L-shaped handle 50 having a center bore or duct 52, is received within the interior of the bushing 46 and secured thereto by an appropriate fastening means, for example, a nut, welding, etc. A portion of element 50 extends through the bushing 46 into the interior of the firebox. The duct 52 traverses the interior of the handle 50 and communicates air from one face of the door 12 to the other. A wire 54 is spirally coiled around the grip portion of the handle 50 and has a generally ellipsoid shape.

Door 14 includes an aperture 56 to receive the bushing 58 which has a collar 60 and center bore 62. The bushing is secured to the door by a weld. Handle 64 is generally L-shaped having a center bore or duct 66. A wire 68 coiled into a generally ellipsoid shape is placed on the grip portion of handle 64. As illustrated in FIG. 3, the rear portion of the bushing 58 includes an interiorly threaded portion 70 which receives an exteriorly threaded portion 72 of the handle 64. A latch 74 is received on the extended threaded portion of handle 64, and secured thereto by a fastener or welding. Whereas handle 22 is fixedly secured to door 12, handle 24 is rotatably mounted to door 14. The thread portion of handle 64 rotates on the threaded portion of bushing 58. The amount of rotation is limited by stops (not shown) provided for the latch 74 on the rear of door 14. The latch 74 rotates up and engages the interior top portion of the front wall of the firebox adjacent to the top of the door 14 so as to lock door 14 closed against the opening. As mentioned previously, the vertical strip 40 engages door 12 to also hold it closed against the heating unit 10.

In the preferred method of assembly for handle 24, the bushing is welded to the door 14. Handle 64 is threaded into the bushing until it steps at a horizontal position. The handle portion is then reversed ninety degrees. The latch 74 is then positioned on the extended threaded portion 72 flush against the rear of bushing 58 in a substantially horizontal position. The latch 74 is welded to the handle 64 with the weld filling the threaded portion 72. By this method of fabrication, the threads provide a rotational stop in one direction and the latch and bushing 58 provide a rotational stop in the other direction. Thus the previous described stops way he eliminated if desired.

Without a fire in the firebox, no air is induced through the ducts 52 and 66 of the handles 22 and 24 respectively. When a fire is built within the firebox 20, the hot air and its circulation up the flue induces cold air from the exterior of the firebox through the ducts 52 and 66 into the interior of the firebox. The hotter the fire and the wider the opening of the flue, the greater the induced air flow. The rush of air or other fluid through ducts 52 and 56 of the handles cools the handle material so as to be relatively cool compared to the doors 12 and 14 when a fire is built in the firebox 20. The coiled wires, 54 and 68, are wound in a substantially open configuration to allow air to circulate therethrough and on the exterior of the handle elements 50 and 64. The coils 54 and 68 being ellipsoid only touch the handle elements 50 and 64 at their extremes and thus reduces the point contact and thereby the amount of thermal conduction into the wire portion of the handles.

To further reduce the conductivity, both of the coil springs 54 and 68 and the knobs 38, of the draft control valve, are coated with a layer of thermal insulation. An example of the type of thermal insulation which may be used is RTV 116 silicon rubber adhesive sealant available from General Electric.

Figure 4:
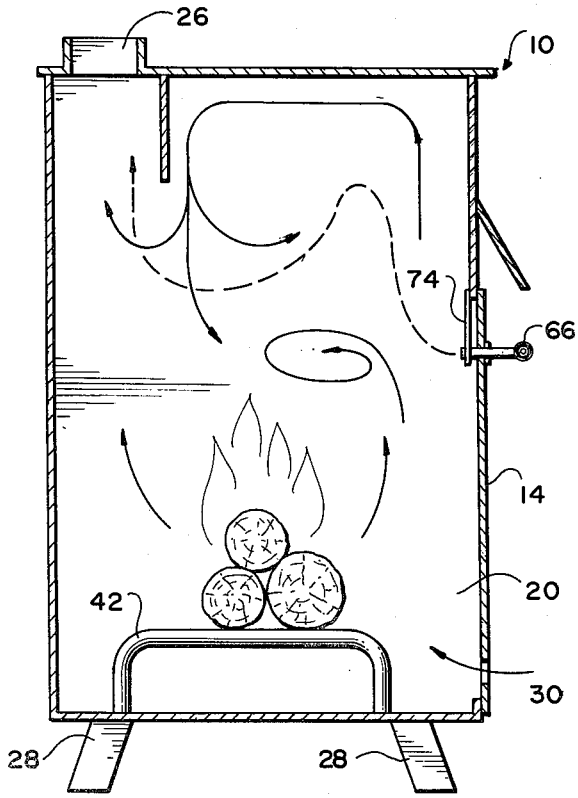
FIG. 4 is a side cross-sectional view schematically illustrating the gas circulation in the firebox according to the principles of the present invention.

No only do the ducts 52 and 66 in the handles provide cooling of the handles, but also provides a source of cool air above the fire to trap the rising hot air closer to the fire for more combustion. As illustrated in FIG. 4, cold air is provided through draft openings 30 at or below the firebed defined by the andirons or grate 42. The heat and hot gases from the fire rise towards the top of the heating unit 10 and exit through a flue opening 26. Additional cold air is drawn into the fireplace through the ducts 54 and 66 as indicated by the dashed arrow to create a layer of cold air above the fire. This limits the hot air rise to cause a more complete combustion. The amount of hot gases reaching the top of the stove and the flue opening 26 is reduced, therefore, reducing the temperature at bottom positions.

From the preceding description of the preferred embodiments, it is evident that the objects of the invention are obtained in that the portions of a heating unit door which are touched or gripped by the user are cooled and/or insulated to prevent thermal conductivity to the hand of the user. Although the invention is described and illustrated in detail, it is to be clearly understood that the same is by way of illustration and example only and is not to be taken by way of limitation. Heating unit 10 has been illustrated as a combined stove or fireplace. The heating unit may be any heating unit requiring a door and may include a closure for a fireplace instead of a free-standing stove or fireplace as illustrated in FIG. 1. The essence of the present invention is to provide a cooled door handle for the door of a heating unit. The spirit and scope of the invention is to be limited only by the terms of the appended claims.

We claim:

1. In a heating unit having a firebox, a flue port, an access opening in a front, closure means for covering said access opening and a handle mounted to said closure means for manipulating said closure means to cover and uncover said access opening, the improvement being said handle comprising a duct means interior to said handle for supplying air from the exterior of said firebox to the interior of said firebox, through said duct means, when said closure means covers said access opening.

2. The heating unit according to claim 1 wherein said handle is L-shaped and has a circular crossection and said duct means is a central bore of said handle.

3. The heating unit according to claim 2 wherein said handle includes a wire coiled around the portion of the L-shape parallel to the plane of said closure means.

4. The heating unit according to claim 3 wherein said wire is coiled into substantially an ellipsoid.

5. The heating unit according to claim 1 wherein said closure means includes a pair of doors and each door includes a handle having a duct means.

6. The heating unit according to claim 1, including a bushing having an internal threaded portion traversing an aperture in said closure means, said handle including a threaded portion mating with the bushing's thread portion and extending beyond the bushing, and a latch secured to the extended portion of said handle for preventing said handle from being unscrewed from said bushing.

7. The heating unit according to claim 6 wherein said bushing includes a collar engaging the exterior of said closure means.

8. The heating unit according to claim 1 wherein said handle is mounted substantially above a firebed in said firebox and said closure means includes adjustable opening at or below said firebed.

9. A door for a heating unit comprising:

a body capable of covering an access opening of a heating unit;

a handle mounted to said body; and a duct means interior to and traversing the length of said handle for providing fluid communication from one face of said body to the other face through said handle to cool said handle.

10. The door according to claim 9 wherein the handle is L-shaped and has a circular cross-section and said duct means is a central bore of said handle.

11. The door according to claim 10 wherein said handle includes a wire coiled around the portion of the L-shape parallel to the plane of said closure means.

12. The door according to claim 11 wherein said wire is coiled into substantially an ellipsoid.

13. The door according to claim 10 wherein said handle is rotatably mounted to said door and includes a latch secured to said handle.

14. The door according to claim 9 wherein said handle is fixedly mounted to said door.

15. The door according to claim 9 including an adjustable opening in said door adjacent to the bottom thereof.

16. The door according to claim 15 wherein a grip portion of said adjustable opening is coated with a silicon thermal insulator.

17. The door according to claim 9 including a wire coiled around the grip of said handle and said wire is coated with a silicon thermal insulator.

18. The method of cooling a handle of a door covering the access opening to the fire box of a heating unit comprising providing a duct interior said handle fluidically communicating the exterior of said firebox with the interior of said firebox through said handle.

19. The method of cooling a handle according to claim 18 including providing an open spiral around and substantially spaced from said handle.

20. The method of cooling a handle according to claim 19 wherein said spiral is formed to have an ellipsoid configuration.

* * * * *